US010149076B2

(12) United States Patent
Dittli et al.

(10) Patent No.: US 10,149,076 B2
(45) Date of Patent: Dec. 4, 2018

(54) HEARING DEVICE WITH AN OPTICAL IDENTIFICATION

(71) Applicant: Sonova AG, Staefa (CH)

(72) Inventors: Erich Dittli, Reichenburg (CH); Andreas Mueller, Gross (CH); Katja Dietrich, Jona (CH)

(73) Assignee: Sonova AG

( * ) Notice: Subject to any disclaimer, the term of this patent is extended or adjusted under 35 U.S.C. 154(b) by 0 days.

(21) Appl. No.: 15/898,262

(22) Filed: Feb. 16, 2018

(65) Prior Publication Data

US 2018/0242089 A1 Aug. 23, 2018

(30) Foreign Application Priority Data

Feb. 23, 2017 (EP) ..... 17157633

(51) Int. Cl.
*H04R 25/00* (2006.01)

(52) U.S. Cl.
CPC ..... *H04R 25/65* (2013.01); *H04R 25/60* (2013.01); *H04R 25/552* (2013.01); *H04R 2225/77* (2013.01)

(58) Field of Classification Search
None
See application file for complete search history.

(56) References Cited

U.S. PATENT DOCUMENTS

2008/0044047 A1* 2/2008 Kral ..... H04R 25/552 381/314
2016/0227334 A1* 8/2016 Johansen ..... H04R 25/60

FOREIGN PATENT DOCUMENTS

| | | | |
|---|---|---|---|
| DE | 4109787 | A1 | 12/1991 |
| EP | 0480097 | A1 | 4/1992 |
| EP | 1890522 | A1 | 2/2008 |
| JP | H0670398 | A | 3/1994 |
| JP | 2001224097 | A | 8/2001 |
| JP | 2005010529 | A | 1/2005 |

OTHER PUBLICATIONS

Internet website, Broadmead Hearing, "Learn What Types of Hearing Aids Are Best for You". Published:Aug. 12, 2015 https://web.archive.org/web/20150812202857/broadmeadhearing.com/hearing-aids/hearing-aid-styles#expand (Year: 2015).*
Extended European Search Report of EP17157633.3.

* cited by examiner

*Primary Examiner* — Antim G Shah

(57) ABSTRACT

A hearing device with an optical or visual identification for a hearing system, wherein the hearing system comprises a left and a right hearing device, wherein each hearing device comprises a housing and an optical or visual identification, wherein the optical or visual identification comprises a first shield and a second shield (a shield is also referred to as a panel) that is physically coupled to the housing, wherein the second shield forms a part of an outer surface of the hearing device, wherein the second shield is arranged over the first shield and wherein the second shield is at least partially transparent.

18 Claims, 5 Drawing Sheets

HEARING DEVICE WITH AN OPTICAL IDENTIFICATION

CROSS-REFERENCE TO RELATED APPLICATION

This application claims priority to European patent application No. 17157633.3, titled "A Hearing Device with an Optical Identification," filed on Feb. 23, 2017, which is incorporated herein by reference for its entirety.

TECHNICAL FIELD

The disclosed technology relates to a hearing system with a left and a right hearing device with an optical or visual identification to distinguish or identify the hearing devices.

BACKGROUND

Users want to easily identify hearing devices. For example, a user wants to be able to easily distinguish a left hearing device from a right hearing device or one hearing device model from another model. A method and system for identifying or distinguishing hearing devices is disclosed in EP 1890522. The patent discloses a colored plate, e.g., blue for the left hearing device and red for the right hearing device. Such color identifications have the disadvantages such as providing limited information (e.g., left or right) or being unhelpful for colorblind individuals. Accordingly, there exists a need to address these shortcomings and improve it.

SUMMARY

In some implementations, the disclosed technology solves a problem of identifying a hearing device or distinguishing a hearing device from another hearing device. The disclosed technology can include an optical identification (also referred to as a "visual" identification) that is versatile and that enables the identification of device-specific information, such as serial number, type and class, or a left or right coding.

In some implementations, the disclosed technology includes a hearing system that comprises a left and a right hearing device each with a housing and an optical identification, wherein the optical identification comprises a first shield and a second shield that are arranged on the housing, wherein the second shield forms a part of the outer surface of the hearing device, wherein the second shield is arranged over the first shield and wherein the second shield is at least partially transparent. In some implementations, the shield is referred to as a "panel", where panel is a flat or curved component that forms or is set into a surface of the hearing device (e.g., exterior or interior surface of a hearing device).

In some implementations, the disclosed technology has the advantage that various information about the hearing device can be allocated or located in one area of the hearing device. Additionally, the first and second shield can be used in any combination on a variety of hearing devices. The transparency of the second shield enables the visibility of information on the first shield through the second shield, at least partially. In some implementations, the hearing system comprises two hearing devices, where one hearing device is the "first hearing device" and the hearing device is the "second hearing device". Although a first hearing device can be the left hearing device and second hearing device can be the right hearing device, it is also possible that the hearing devices are generic (e.g., not programmed for left or right).

At least partially transparent generally means that the entire second shield is made from a material that is transparent or semi-transparent. Alternatively, the second shield can comprise regions, like windows, that are transparent or semi-transparent. This enables a great number of variations and provides a great flexibility in application.

In an embodiment, the first shield comprises a first identification feature and the second shield comprises a second identification feature. Having different identification features on the first and second shield facilitates the recognition of each feature. In another embodiment, the first and second identification feature is at least one of sign or color. Signs and color can be easily detected and recognized by the human eye. A sign can comprise one or more signs and can comprise one or more type of signs. Signs can be selected from the group of letter, number and shape, alone or in combination.

In a further embodiment, the first identification feature is a sign and the second identification feature is a color. This enables the clear distinction between identification features on the first shield and those on the second shield. For example, technical information of the hearing device, such as serial number, type or class, can be allocated on the first shield and usage information, such as usage for the left or the right ear, can be allocated on the second shield. With this setup, the first shield can be used for any hearing device with the same technical specification and the second shield can be used for any hearing device that is to be placed in the same ear.

In some embodiments, the housing comprises a recess for receiving the second shield. This enables a substantially flush arrangement of the second shield with respect to the housing. Such a design is optically appealing and avoids protruding parts that are not comfortable for the user and are prone to things getting stuck on them.

In another embodiment, at least one outer rim of the recess forms a first retention for the second shield. With this, the second shield can easily be arranged and cantered within the recess. With one first retention, the second shield can be slipped in the recess from the side opposite the first retention. With two or more first retentions, the second shield needs to be flexible, meaning reversible deformable, so that it can be bent and squeezed in the recess to engage in a form fit with the corresponding part of the housing. With such a design, no additional fixation means is necessary.

In a further embodiment, the second shield comprises a disk-shaped body, wherein at least one inner rim of the body forms a first nose that is adapted to engage the corresponding first retention of the housing. The number of noses corresponds with the number of retentions in the housing. Alternatively, there can be less noses than retentions. The shape of each nose corresponds to the shape of each respective retention.

According to another embodiment, the second shield comprises a second nose that extends from the surface defined by the inner rim of the body and wherein the device further comprises a second retention for the second shield. The second retention abuts the housing from the inside at least in a central area of the recess. The second retention extends towards the second shield over the first shield and is adapted to engage the second nose of the second shield. The combination of the first retention with the first nose and the second retention with the second nose form a snap closure.

Such a design does not require an additional fixation means, such as a screw that is difficult to tighten and can easily be lost.

In an embodiment, the part of the second retention that extends over the first shield is a notch. A notch can easily be manufactured and its design enables an accurate setting of a desired retention force. According to an embodiment, the second retention is an elongate element that is arranged in a central region of the recess of the housing and extends through a corresponding cut in the first shield. With this, the first shield is centered by the second retention.

In a further embodiment, the second retention extends through an inner surface of the recess and the area of the inner surface around the second retention is made of a sealing element. This prevents liquids and particles from entering the inner part of the housing, where electronics is located.

In yet another embodiment, the second retention is a flat element that extends over more than the entire width of the recess of the housing and extends sideways around the first shield. With this, the first shield is well positioned and no additional retention element is needed.

Per an embodiment, the second retention forms an inner surface of the recess and a sealing element is arranged around the second retention in the region where the second retention abuts the housing. The sealing element is for example an 0-ring or the like.

In a further embodiment, the hearing device comprises a relief on the side of the body of the second shield opposite to the first nose that is formed by the second shield and the housing, wherein the relief is adapted to allow the engagement with a tool for removing the second shield. The relief can be defined mainly by the second shield or can be defined mainly by the housing. The relief can be defined on at least three sides by the second shield and on at least one side by the housing or the relief can be defined on at least three sides by the housing and on at least one side by the second shield.

A hearing system can comprise a left and a right hearing device according to one of the above-mentioned embodiments.

According to another embodiment, the hearing device comprises a clearance that is adapted to form a snap connection with a corresponding loading station. The clearance can be formed in the housing or in the second shield. The allocation of the clearance in the second shield enables an easy adaption of the hearing device to a loading station by simply changing the second shield. In a further embodiment, the second shield is a circular disk, that can be inserted in a circular recess in the 25 housing. The recess in the housing comprising reliefs for receiving latches arranged on the circumference of the second shield. The second shield comprising a recess in which a tool, such as a screw driver, a coin or the like can be inserted for loosening the second shield within the recess of the housing by means of a rotary movement. The second shield and the housing forming a Bayonet closure.

The first shield can be arranged in a relief in the recess of the housing or can be arranged in a relief in the second shield. A sealing element can be arranged in a peripheral area of the second shield. The features of the above-mentioned embodiments of the hearing device can be used in any combination, unless they contradict each other.

BRIEF DESCRIPTION OF THE FIGURES

Embodiments of the disclosed technology are described in more detail in the following with reference to the figures. These are for illustrative purposes only and are not to be construed as limiting.

DETAILED DESCRIPTION

Figure 1:
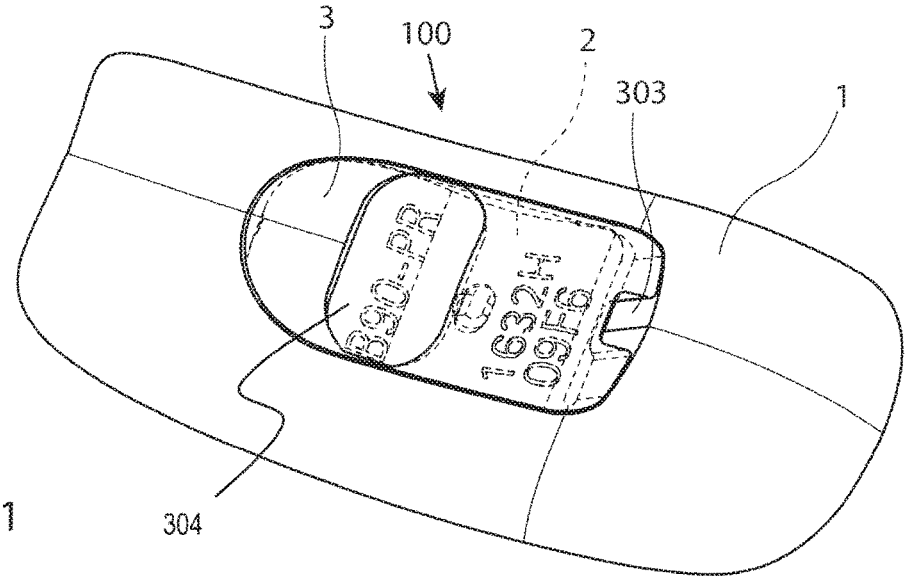
FIG. 1 a perspective partial view of a hearing device with an optical identification in accordance with some implementations of the disclosed technology.

FIG. 1 shows a perspective partial view of a hearing device with an optical identification according to a first embodiment. The hearing device comprises a housing 1 and an optical identification 2, 3, wherein the optical identification 2, 3 comprises a first shield 2 and a second shield 3 that are arranged on the housing 1. The second shield forms a part of the outer surface of the hearing device or the housing, respectively. The second shield 3 is arranged over the first shield 2 in a recess 100 of the housing 1. The first shield 2 comprises a first identification feature, e.g., a serial number, a type and a class and the second shield 3 comprises a second identification feature, e.g., is transparent red. The second shield 3 comprises a relief 303 that is adapted to allow the engagement with a tool for removing the second shield from the housing 1. A clearance 304 is formed in the second shield 3, wherein said clearance 304 is adapted to form a snap connection with a corresponding loading station (not shown).

Figure 2:
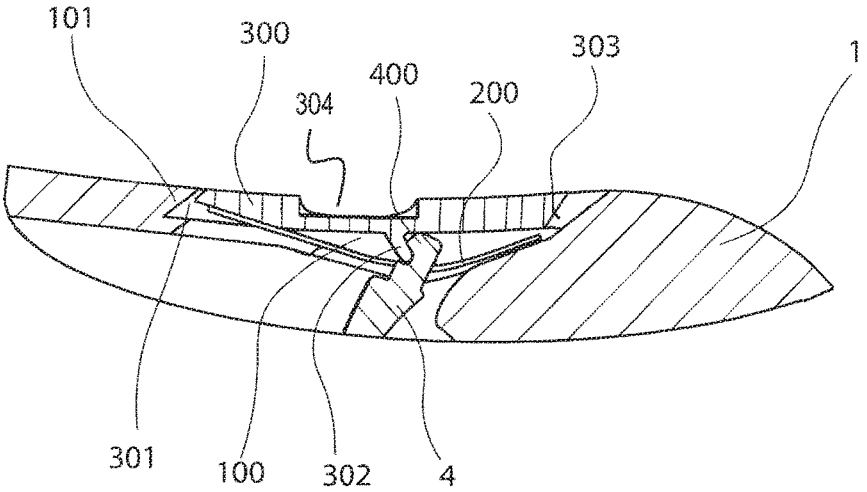
FIG. 2 a side section view of FIG. 1 in accordance with some implementations of the disclosed technology.

FIG. 2 shows a side section view of FIG. 1. The recess 100 of housing 1 comprises an outer rim which forms a first retention 101 for the second shield 3. The second shield 3 comprises a disk-shaped body 300. An inner rim of the body 300 forms a first nose 301 that is adapted to engage the corresponding first retention 101 of the housing. The second shield 3 comprises a second nose 302 that extends from the surface defined by the inner rim of the body 300. The hearing device further comprises a second retention for the second shield 3, wherein the second retention abuts the housing 1 from the inside in a central region of the recess 100 of the housing 1. The second retention 4 extends through an opening in the recess 100 through a cut in the first shield 2. At its free end, the second retention 4 comprises a notch 400 that is adapted to engage the second nose 302 of the second shield 3. The first shield 2 comprises a flexible disk-shaped body 200 that can adapt its form to the recess 100 of the housing 1. The depth of the clearance 304 extends over a part of the thickness of the second shield 3.

Figure 3:
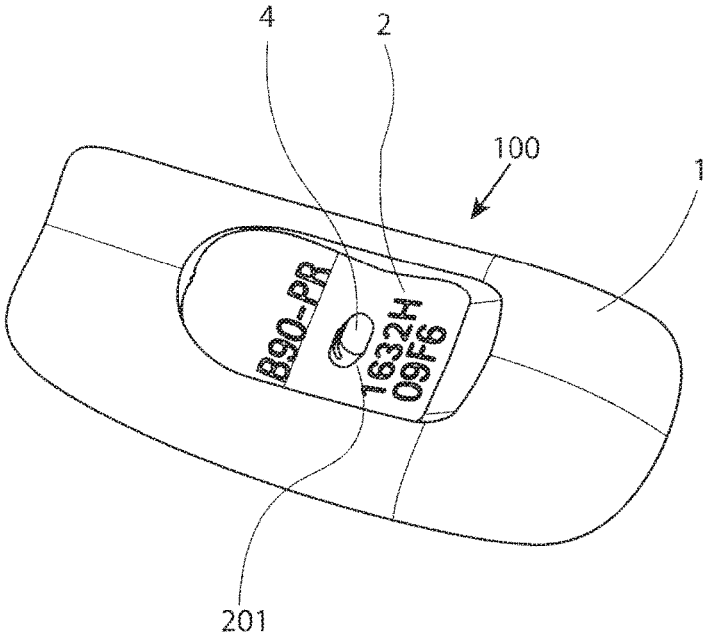
FIG. 3 the view of FIG. 1 without a second shield in accordance with some implementations of the disclosed technology.

FIG. 3 shows the view of FIG. 1 without the second shield. The first shield 2 being placed at the bottom of the recess 100 and being held in its position by the second retention 4 that reaches through the cut 201 in the first shield 2. The first shield 2 comprises written information in various areas.

Figure 4:
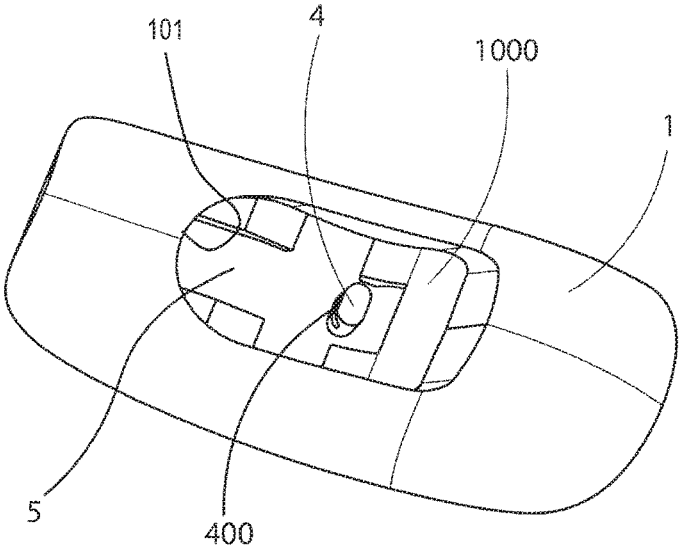
FIG. 4 the view of FIG. 3 without a first shield in accordance with some implementations of the disclosed technology.

FIG. 4 shows the view of FIG. 3 without the first shield. The second retention 4 extends through an inner surface 1000 of the recess. The area of the inner surface 100 around the opening for the second retention 4 is made of a sealing element 5. Depicted is a cross-shaped sealing element 5 which extends in a first direction over the whole width of the inner surface 1000 and which extends from the opening for the second retention in a second direction, which is perpendicular to the first direction. On the side of the first retention 101, the sealing element 5 extends to said first retention 101 and extends on the opposite side of the opening for the second retention 4 only over a part of the inner surface 1000.

Figure 5:
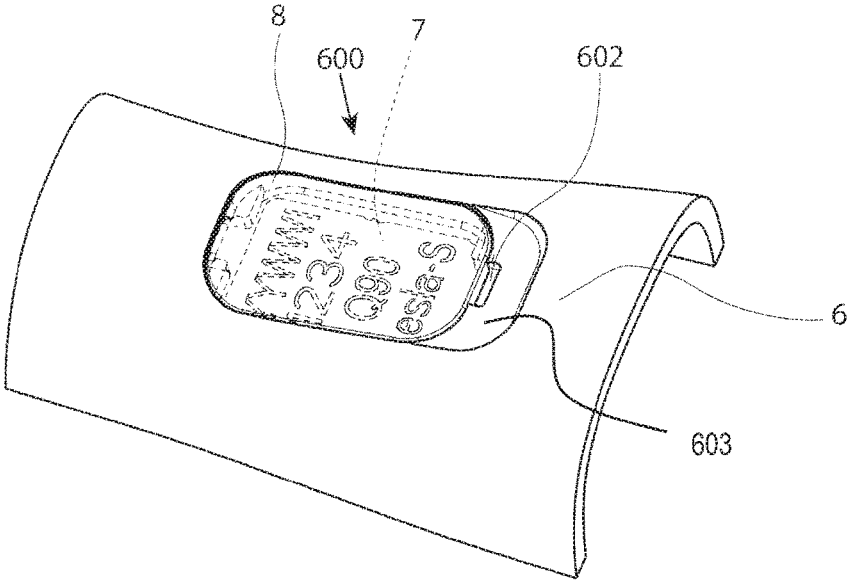
FIG. 5 a perspective partial view of a hearing device with an optical identification according to a second embodiment in accordance with some implementations of the disclosed technology.

FIG. 5 shows a perspective partial view of a hearing device with an optical identification according to a second embodiment. The hearing device comprises a housing 6 and an optical identification 7, 8, wherein the optical identification 7, 8 comprises a first shield 7 and a second shield 8 that are arranged on the housing 6. The second shield 8 forms a part of the outer surface of the hearing device or the housing 6, respectively. The second shield 8 is arranged over the first shield 7 in a recess 600 of the housing 6. The first shield 7 comprises a first identification feature, e.g., a serial number, a type and a class and the second shield 8 comprises a second identification feature, e.g., is transparent red. The housing 6 comprises a relief 602 that is adapted to allow the engagement of a tool with the second shield 8 for removing the same from the housing 6. A clearance 603 is formed in the housing 6, wherein said clearance 603 is adapted to form a snap connection with a corresponding loading station (not shown).

Figure 6:
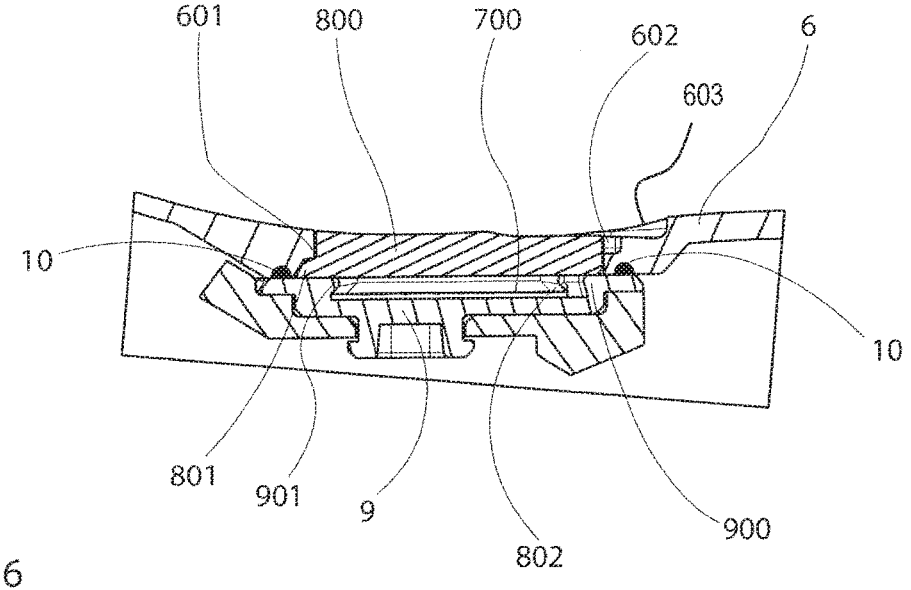
FIG. 6 a side section view of FIG. 5 in accordance with some implementations of the disclosed technology.

FIG. 6 shows a side section view of FIG. 5. The recess 600 of housing 6 comprises an outer rim which forms a first retention 601 for the second shield 8. The second shield 8 comprises a disk-shaped body 800. An inner rim of the body 800 forms a first nose 801 that is adapted to engage the corresponding first retention 601 of the housing 6. The second shield 8 comprises a second nose 802 that extends from the surface defined by the inner rim of the body 800. The hearing device further comprises a second retention 9 for the second shield 8, wherein the second retention 9 abuts the housing 6 from the inside in a peripheral region of the recess 600 of the housing 6 and forms an inner surface of the recess 600. The second retention 9 extends toward the second shield 8 over the first shield 7 and is adapted to engage the second nose 802 of the second shield 8. The second retention 9 comprises a recess for receiving the first shield. The upper rim of said recess on the side of the first retention 601 and on the opposite side thereof is designed as notch 900, 901, wherein the notch 900 opposite the first retention 601 is adapted to engage the second nose 802 of the second shield 8. A sealing element 10 is arranged around the second retention 9 in the region where the second retention 9 abuts the housing 6. The depth of the clearance 603 extends over a part of the thickness of the housing 6.

Figure 7:
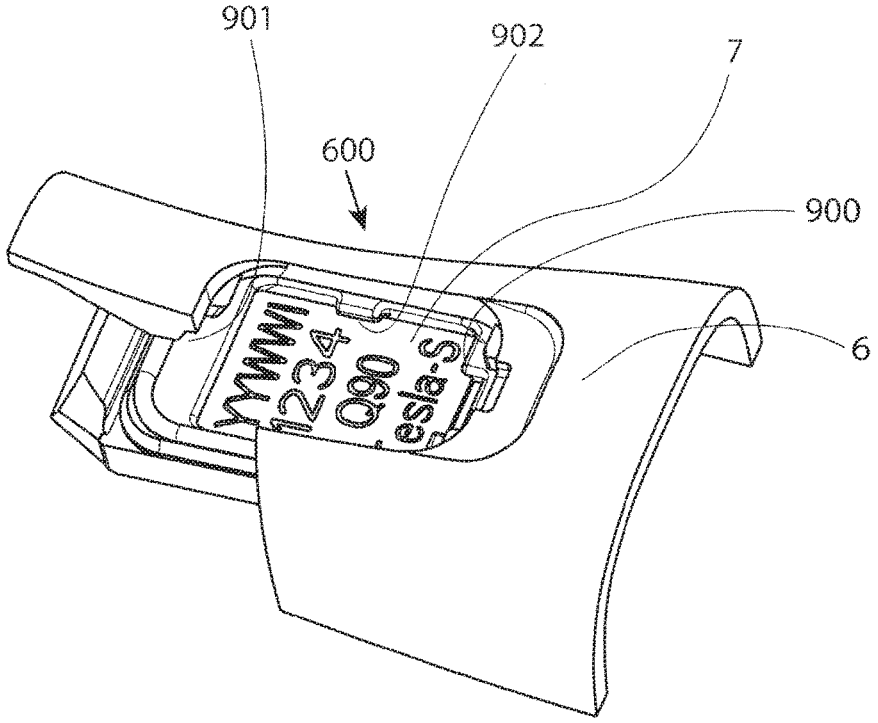
FIG. 7 the view of FIG. 5 without a second shield in accordance with some implementations of the disclosed technology.

FIG. 7 shows the view of FIG. 5 without the second shield. For a better visibility, there is a partial cut-out in the housing 6. The first shield 7 being placed at the bottom of the recess 600 and being held in its position by the second retention 9 that extends sideways over the first shield 7. In addition to the notch 901 on the side of the first retention 601 and the notch 900 on the opposite side thereof, lateral notches 902 are provided. The first shield 7 comprises written information in various areas.

Figure 8:
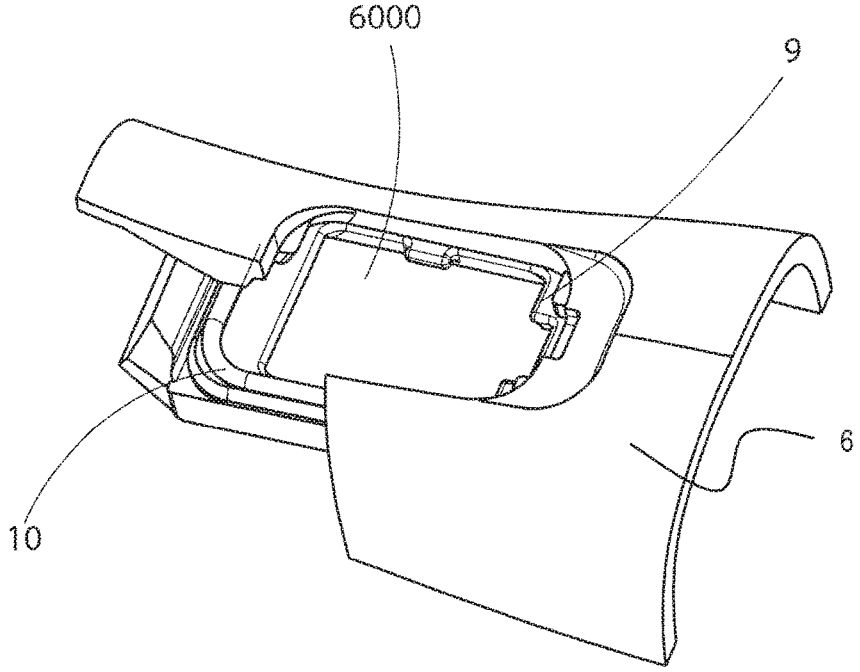
FIG. 8 the view of FIG. 7 without a first shield in accordance with some implementations of the disclosed technology.

FIG. 8 shows the view of FIG. 7 without the first shield. The second retention 9 forms the inner surface 6000 of the recess. The depicted sealing element 10 is an 0-Ring that seals the second retention 9 against the housing 6 around the periphery of the second retention 9.

Figure 9:
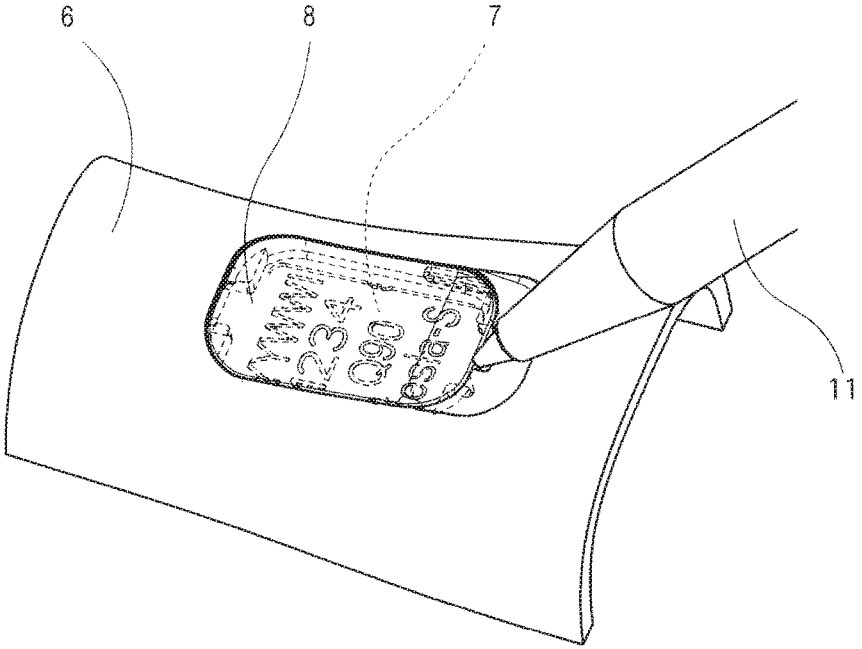
FIG. 9 the view of FIG. 5 with a tool for removing the second shield in accordance with some implementations of the disclosed technology.

FIG. 9 shows the view of FIG. 5 with a tool 11 for removing the second shield 8. A tip of the tool can be placed between the housing 6 and the second shield 8. When the tool 11 is tilted, the second shield 8 can be removed from the housing 6.

Figure 10:
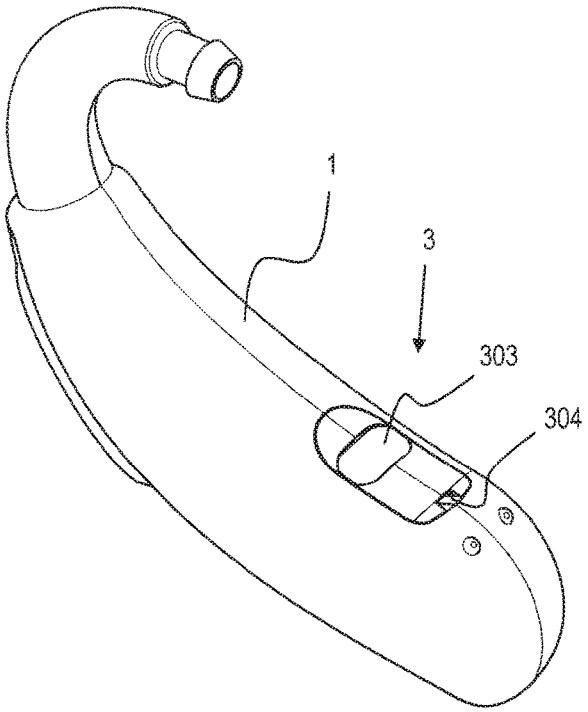
FIG. 10 a perspective view of a hearing device with an optical identification in accordance with some implementations of the disclosed technology.

FIG. 10 shows a perspective view of a hearing device with an optical identification in accordance with some implementations of the disclosed technology. The outside surface of the second shield 3 is essentially flush with the outside surface of the housing 1. The second shield 3 is arranged on a side facing the back of an ear of a user in its intended use position. Thus, the second shield is only visible when the hearing device is removed from the user's ear. During use, the colored shield is not visible, which makes the hearing device less conspicuous. As can be seen, the dimensions of the relief 303 and the clearance 304 with respect to the dimensions of the whole hearing device are relatively small. Therefore they are not or barely noticeable by a user.

| REFERENCE LIST | |
|---|---|
| 1 | Housing |
| 100 | Recess |
| 1000 | inner surface |
| 101 | first retention |
| 2 | first shield |
| 200 | Body |
| 201 | Cut |
| 3 | Second Shield |
| 300 | Body |
| 301 | First Nose |
| 302 | Second Nose |
| 303 | Relief |
| 304 | Clearance |
| 4 | Second Retention |
| 400 | Notch |
| 5 | Sealing element |
| 6 | Housing |
| 600 | Recess |
| 6000 | inner surface |
| 601 | First Retention |
| 602 | Relief |
| 603 | Clearance |
| 7 | First Shield |
| 700 | Body |
| 8 | Second Shield |
| 800 | Body |
| 801 | First Nose |
| 802 | Second Nose |
| 9 | second retention |
| 900 | Notch |
| 901 | Notch |
| 902 | Notch |
| 10 | Sealing element |
| 11 | Tool |

We claim:

1. A hearing device, the device comprising:

a housing; and an optical identification, wherein the optical identification comprises a first shield and a second shield physically coupled to the housing, wherein the second shield forms a part of an outer surface of the hearing device, wherein the second shield is positioned over the first shield, wherein the second shield is at least partially transparent, wherein the first shield comprises a first identification feature, wherein the second shield comprises a second identification feature, and wherein the first identification is different from the second identification feature.

2. The hearing device of claim 1, wherein the hearing device is part of a hearing system and the hearing device is a first hearing device, and the hearing system includes a second hearing device.

3. The hearing device of claim 2, wherein the first and second identification features are a sign, color, or combination thereof.

4. The hearing device of claim 1, wherein the first identification feature is a sign and wherein the second identification feature is a color.

5. The hearing device of claim 1, wherein the housing comprises a recess for receiving the second shield.

6. The hearing device of claim 4, wherein at least one outer rim of the recess forms a first retention for the second shield.

7. The hearing device of claim 5, wherein the second shield comprises a disk-shaped body, wherein at least one inner rim of the disk-shaped body forms a first nose that is adapted to engage a first retention of the housing.

8. The hearing device of claim 6, wherein the second shield comprises a second nose that extends from the surface defined by the inner rim of the body and wherein the device further comprises a second retention for the second shield, wherein the second retention abuts the housing from the inside at least in a central area of the recess, extends towards the second shield over the first shield and is adapted to engage the second nose of the second shield.

9. The hearing device of claim 7, wherein the part of the second retention that extends over the first shield is a notch.

10. The hearing device of claim 8, wherein the second retention is an elongated element that is positioned in a central region of the recess of the housing and extends through a corresponding cut in the first shield.

11. The hearing device of claim 7, wherein the second retention extends through an inner surface of the recess and wherein the area of the inner surface around the second retention is made of a sealing element.

12. The hearing device of claim 8, wherein the second retention is a flat element that extends over more than the entire width of the recess of the housing and extends sideways around the first shield.

13. The hearing device of claim 11, wherein the second retention forms an inner surface of the recess and wherein a sealing element is arranged around the second retention in the region where the second retention abuts the housing.

14. The hearing device of claim 6, wherein each hearing device comprises a relief on the side of the body of the second shield opposite to the first nose that is formed by the second shield and the housing, wherein the relief is adapted to enable an engagement with a tool for removing the second shield.

15. An apparatus to hear, the apparatus comprising:

a first hearing device; and a second hearing device, wherein the first and second hearing devices comprise a housing and a visual identification, wherein the visual identification comprises a first panel and a second panel that are physically coupled to the housing, wherein the second panel forms a part of an exterior surface of each hearing device, respectively, wherein the second panel is disposed over the first panel, wherein the second panel is at least partially or completely transparent, wherein the first or second panels are changeable, wherein the first panel comprises a first identification feature, wherein the second panel comprises a second identification feature, and wherein the first identification is different from the second identification feature.

16. The apparatus of claim 15, wherein the first or second identification features are one of the following: a sign or color.

17. The apparatus of claim 16, wherein a sign is at least one of the following: a letter, number, shape, or a combination thereof.

18. The apparatus of claim 15, wherein the housing comprises a recess for receiving the second panel, and wherein the first hearing device is a right hearing device and the second hearing device is left hearing device.

* * * * *